US007793870B2

(12) United States Patent
Gerschwiler et al.

(10) Patent No.: US 7,793,870 B2
(45) Date of Patent: Sep. 14, 2010

(54) METHOD AND DEVICE FOR HUSKING AND DEGERMINATING CEREALS

(75) Inventors: Othmar Gerschwiler, Jonschwil (CH); Walter Eugster, Niederuzwil (CH); Urs Zwahlen, Ermatingen (CH)

(73) Assignee: Bühler AG, Uzwil (CH)

( * ) Notice: Subject to any disclaimer, the term of this patent is extended or adjusted under 35 U.S.C. 154(b) by 194 days.

(21) Appl. No.: 10/533,590

(22) PCT Filed: Jan. 27, 2003

(86) PCT No.: PCT/CH03/00061

§ 371 (c)(1),
(2), (4) Date: May 3, 2005

(87) PCT Pub. No.: WO2004/041434

PCT Pub. Date: May 21, 2004

(65) Prior Publication Data

US 2006/0053764 A1 Mar. 16, 2006

(30) Foreign Application Priority Data

Nov. 4, 2002 (DE) ..... 102 51 490

(51) Int. Cl.
*B02C 9/00* (2006.01)

(52) U.S. Cl. ..... 241/12; 241/13; 241/57; 241/247; 241/260

(58) Field of Classification Search ..... 241/6–12, 241/247, 260, 261.1, 13, 57; 99/519
See application file for complete search history.

(56) References Cited

U.S. PATENT DOCUMENTS

| | | | | |
|---|---|---|---|---|
| 862,975 | A | 8/1907 | Kerr et al. | |
| 3,476,326 | A | 11/1969 | Rado et al. | |
| 4,229,486 | A * | 10/1980 | Muller | 426/483 |
| 4,581,798 | A | 4/1986 | Yamamoto | |
| 4,583,455 | A | 4/1986 | Salete-Garces | |
| 5,036,757 | A * | 8/1991 | Mueller | 99/519 |
| 6,953,165 | B1 * | 10/2005 | Griebat et al. | 241/11 |
| 7,246,762 | B2 * | 7/2007 | VanHouten et al. | 241/6 |

FOREIGN PATENT DOCUMENTS

EP 0 335 925 B1 10/1989

* cited by examiner

*Primary Examiner*—Mark Rosenbaum
(74) *Attorney, Agent, or Firm*—Finnegan, Henderson, Farabow, Garrett & Dunner, LLP

(57) ABSTRACT

The invention relates to a method and a device for husking and degerminating grains of maize. The aim of the invention is to provide an efficient and simple degermination of maize. To this end, during a wet degermination process, cleaned maize is wetted, and then husked and degerminated, and directly supplied to the comminution stage.

18 Claims, 3 Drawing Sheets

30
21
31
20
32
33
34

METHOD AND DEVICE FOR HUSKING AND DEGERMINATING CEREALS

The invention relates to a process and a device for husking and seeding grains and the like, in particular corn.

A device for husking and seeding corn grains is known from WO 89/00454. This device has a stator, in the housing whereof a rotor is swivel-mounted horizontal, which is fed with naps at least partially in the region of the processing space. The interior of the stator housing delimiting the processing space has screening elements fitted with a screen perforation and contains at least two detachable housing wall parts. At least the detachable housing wall parts each have at least a nap segment, which can be adjusted radially to the axis of rotation of the rotor.

The corn grains are first prepared with water and/or steam, then husked and seeded and the husk-free discard is sifted and further processed. The screenings is sifted separately.

Also known is a husking machine with vertically arranged rotor, whereof the discard is guided into a polishing machine and if required another screen is arranged between both machines. The corn grains are husked by this process, then polished, aspirated and again wet. This is followed by standing for 10 min. prior to milling.

The object of the invention is to develop a process for husking and seeding corn grains, which enables further simplification of the process at a higher yield and product quality. This task is solved by the characteristics of claim 1. Cleaned and wet corn is husked and seeded and the husked corn grains are fed directly to processing/comminution.

If required, just one more sifting is arranged upstream, for example in an aspiration channel of the processing.

The processing itself is substantially simplified, the plant and maintenance costs decrease and operating is simplified. Surprisingly, yields and product quality as well as efficiency could be massively increased, in particular during the dry seeding process. Machinery costs in comminution to grits can also be noticeably reduced.

A further object of the invention comprises creating a device for husking and seeding corn grains. This object is solved by the characteristics of claim 5. The device has a processing zone with adaptable baffles and a rotor with projections over the length of the processing zone and air slots. The distance between strainer basket and rotor is variable.

The invention will now be described in greater detail hereinbelow in an embodiment by means of a diagram, in which.

Figure 1:
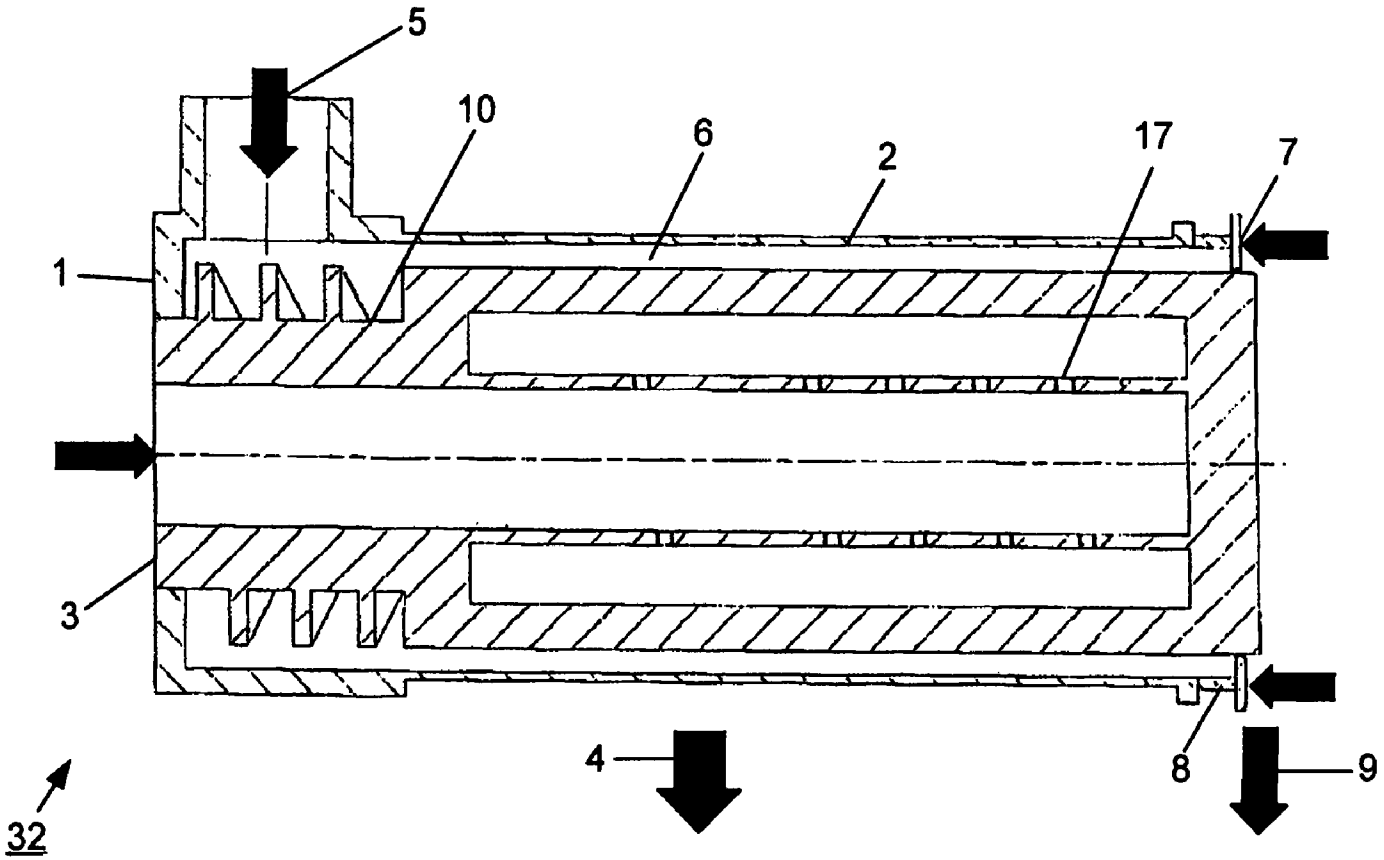
FIG. 1 illustrates a device in section.
Figure 2:
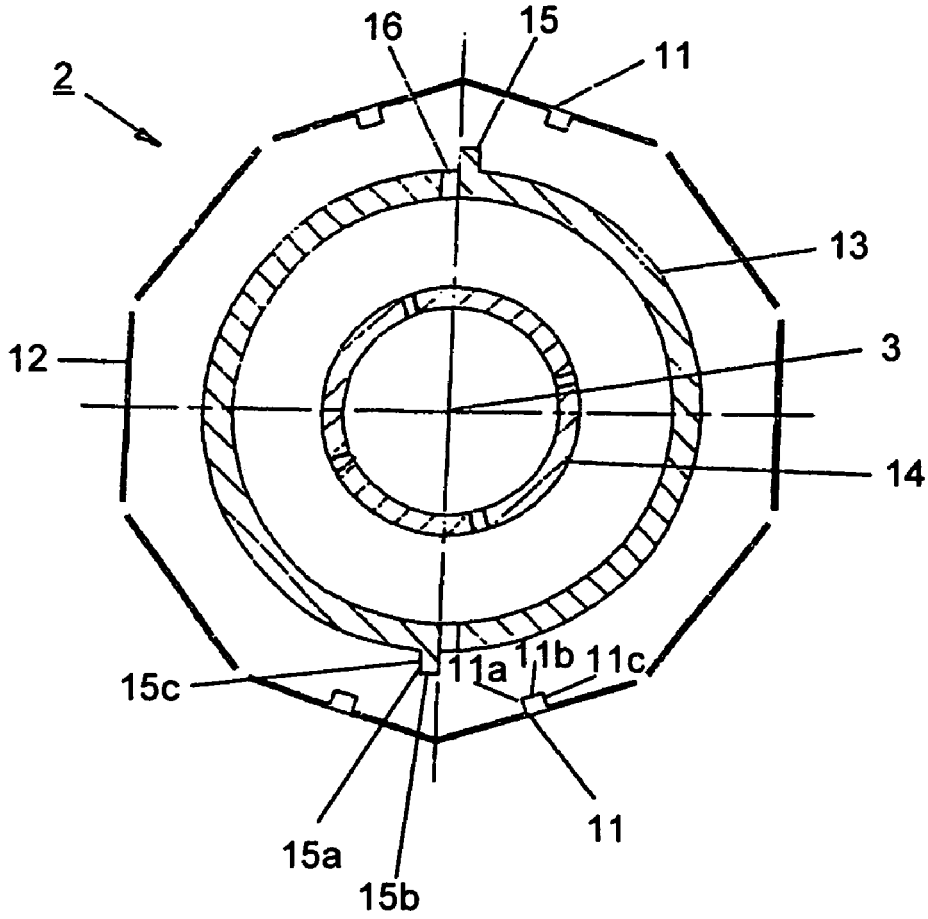
FIG. 2 illustrates a cross-section of the processing zone.
Figure 3:
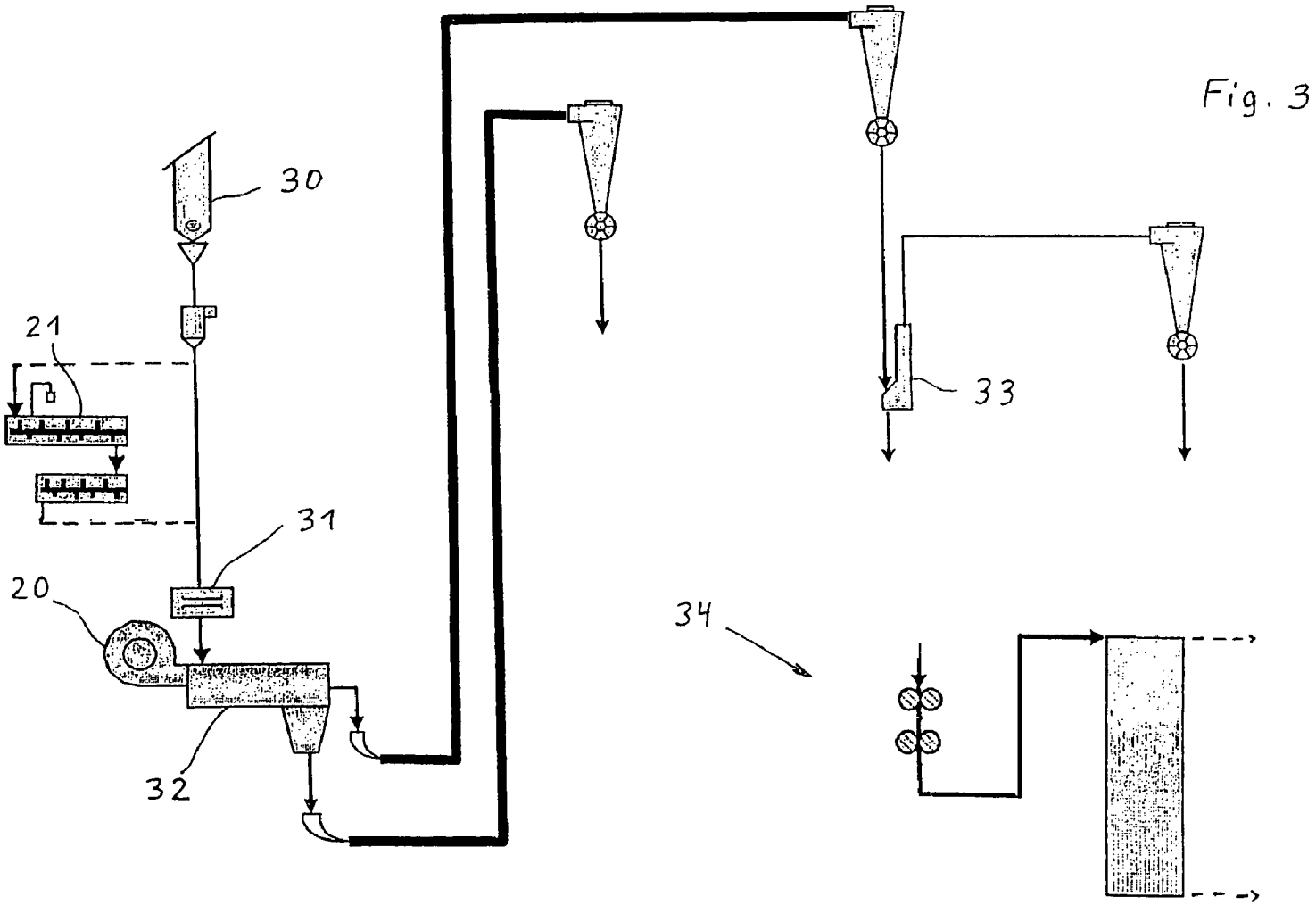
FIG. 3 illustrates a procedural diagram.

The stator 1 of the device (corn seeding machine 32) has a housing 2, which surrounds a rotor 3 mounted therein, and is mounted on a frame and is open downwards through a connecting discharge 4. Via this discharge 4 the screenings are discarded from seeds, husk meal and husking parts.

The corn grains enter the processing zone 6 via a feed screw 10 from a product inlet 5. During husking/seeding the corn grains are guided against an adjustable storage device 7, in order to develop a specific processing pressure in the processing zone 6. The seeded corn grains leave the processing zone 6 via an adjustable discharge opening 8 and via a discharge 9 of the seeding machine.

The processing zone on the stator side is formed by four baffles 11 and two strainer basket halves 12, whereby every two baffles 11 are arranged above and two are arranged below on the stator 1 and in between the strainer basket halves 12 are arranged such that they fully encircle the rotor 3 with the baffles 11 in an axial direction. Baffles 11 include edges 11*a* that are defined by side planar surfaces 11*c* and an upper planar surface 11*b*. The rotor 3 is composed of a cast roller 13 with a hollow shaft 14. The roller 13 contains at least two projections 15 and assigned slots 16, which are arranged on the periphery of the roller 13 spaced uniformly from one another, and which extend over the entire length of the processing zone 6. Projections 15 include edges 15*a* that are defined by side planar surfaces 15*c* and an upper planar surface 15*b*.

The hollow shaft 14 has a plurality of openings 17 for the discharge of air. The air enters the processing zone 6 through the slots 16 in the roller 13 and supports the product passing through the screen. The air is pressed into the hollow shaft 14 by means of a ventilator 20.

With moist seeding cleaned and wet corn is fed to the corn-seeding machine 32 via a metering device 30 and a magnet 31, where it is husked and seeded. Surface wetting (husk wetting) of the grains during wetting in the wetting unit 21 takes place briefly only. The screenings comprises husk and husk meal, and the discard of seeded corn grains enters an aspiration channel 33, where loosened husking parts are separated in the air current. The aspirated corn grains enter the mill and the first two milling passes (B1, B2) 34 are run through without intermediate sifting (according to the teaching of EP-B-335925). Only after the second comminution stage are the grits sifted and sent on to further milling passes.

During dry seeding surface wetting in the wetting unit 21 is dispensed with and only seeding takes place. This results in an essentially higher yield, similar to conventional wet seeding.

During wet seeding it is possible to markedly increase output. The product quality remains constant.

On account of the smaller machine park plant costs fall substantially, and maintenance costs and staff expenditure also drop.

The invention is not limited to this exemplary embodiment.

LEGEND

1 stator
2 housing
3 rotor
4 discharge
5 product inlet
6 processing zone
7 storage device
8 discharge opening
9 discharge
10 feed screw
11 baffle
12 strainer basket half
13 roller
14 hollow shaft
15 projection
16 slot
17 opening
20 ventilator
21 wetting unit
30 metering device
31 magnet
32 corn seeding machine
33 aspiration channel
34 milling pass

The invention claimed is:

1. A process for seeding corn grains, including:

dry cleaning the corn grains;

seeding the corn grains immediately thereafter in a processing zone between baffles of a stator and a roller, the roller having a plurality of edged outward projections and assigned slots positioned adjacent to the baffles on the roller; the plurality of edged outward projections including edges defined by planar surfaces;

entering air into the processing zone through the assigned slots;

aspirating the seeded corn grains; and directly milling the aspirated seeded corn grains into grits or meal.

2. The process of claim 1, including:

beginning comminuting with double milling without any intermediate sifting between the comminution stages.

3. The method of claim 1 including seeding the grains by impacting the grains between the baffles and the projections, a relative motion between the baffles and the projections providing the impact force for seeding, and wherein the baffles extend radially inward into the processing zone.

4. A process for seeding corn grains, including:

cleaning the corn grains by surface wetting; and seeding the corn grains immediately thereafter in a processing zone between baffles of a stator and a roller, the roller having:

a plurality of edged outward projections that include edges defined by planar surfaces; and assigned slots configured to convey air, the slots positioned adjacent to the baffles on the roller, wherein seeding the corn grains includes introducing air through the assigned slots.

5. A device for seeding corn grains, comprising:

a swivel-mounted rotor, including processing tools;

a stator containing processing tools;

a strainer enclosing the rotor to form a processing zone, wherein the rotor includes a hollow shaft enclosed in a region of the processing zone by a roller; the outermost surface of the hollow shaft being separate from an innermost surface of the roller, and wherein the roller has a plurality of edged projections that elongate parallel to an axis of rotation of the rotor and that include edges defined by planar surfaces; and a plurality of assigned slots configured to convey air such that a flow connection is established between the processing zone and the hollow shaft, each of the assigned slots being located adjacently to the edged projections of the roller.

6. The device of claim 5 wherein the plurality of projections include two projections.

7. The device of claim 5, wherein the projections extend over the processing zone.

8. The device of claim 5, wherein the projections are arranged over the periphery of the roller and are spaced uniformly from each other.

9. The device of claim 5, wherein the hollow shaft is connected to a ventilator for conveying air to the roller.

10. The device of claim 5, wherein the hollow shaft has openings in the region of the processing zone.

11. The device of claim 5 wherein the stator baffles extend radially inward into the processing zone.

12. A device for seeding corn grains, comprising:

a rotor including a hollow shaft having a plurality of openings;

a roller disposed radially outward from the shaft and including a plurality of edged projections that elongate parallel to the axis of rotation of the rotor and that include edges defined by planar surfaces, the roller further including a plurality of assigned openings configured to convey air and located adjacently to the edged projections of the roller such that a flow connection is established between the processing zone and the hollow shaft;

a stator having a plurality of baffles and being disposed radially outward from the roller; and wherein the space between the stator and the roller forms a processing zone.

13. The device of claim 12, wherein a relative motion of the baffles to the projections provides an impact force for seeding.

14. The device of claim 12 wherein the stator baffles extend radially inward into the processing zone.

15. The device of claim 12 wherein the stator baffles have edges defined by planar surfaces.

16. An apparatus for seeding corn grains, comprising:

a rotor including a hollow shaft;

a roller rotatable with the shaft disposed radially outward from the shaft and including:

a plurality of edged projections that extend radially outward from the roller and elongate parallel to the axis of rotation of the rotor;

a stator having a plurality of strainers and edged baffles encircling the rotor in the axial direction, the baffles extending radially inward from the strainers;

wherein the space between the stator and the roller defines a processing zone;

wherein the baffles and the projections extend into the processing zone; and wherein a relative motion between the baffles and the projections provides an impact force for seeding the corn grain; and a plurality of assigned slots configured to convey air such that a flow connection is established between the processing zone and the hollow shaft, each of the assigned slots being located adjacently to the edged projections of the roller.

17. The apparatus of claim 16 further including an adjustable storage device for developing a specific processing pressure in the processing zone.

18. The apparatus of claim 16 wherein the edged baffles and the edged projections are configured to seed corn grains.

* * * * *